US011490684B2

(12) United States Patent
Kurcinka et al.

(10) Patent No.: US 11,490,684 B2
(45) **Date of Patent: *Nov. 8, 2022**

(54) DROP-IN UNITARY FOOTWEAR SOLE WITH FIRST AND SECOND CUSHIONING BODIES OF DIFFERING HARDNESS

(71) Applicant: NIKE, Inc., Beaverton, OR (US)

(72) Inventors: Kristina L. S. Kurcinka, Portland, OR (US); Jeffrey S. To, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 23 days.

This patent is subject to a terminal disclaimer.

(21) Appl. No.: 16/951,350

(22) Filed: Nov. 18, 2020

(65) Prior Publication Data

US 2021/0068500 A1 Mar. 11, 2021

Related U.S. Application Data

(63) Continuation of application No. 16/167,677, filed on Oct. 23, 2018, now Pat. No. 10,932,522.

(Continued)

(51) Int. Cl.

*A43B 13/18* (2006.01)
*A43B 13/16* (2006.01)

(Continued)

(52) U.S. Cl.

CPC ..... *A43B 13/186* (2013.01); *A43B 7/142* (2013.01); *A43B 7/143* (2013.01); *A43B 7/144* (2013.01);

(Continued)

(58) Field of Classification Search

CPC ..... A43B 13/16; A43B 13/186; A43B 13/188; A43B 13/12; A43B 17/14; A43B 17/00; A43B 17/02

See application file for complete search history.

(56) References Cited

U.S. PATENT DOCUMENTS 4,769,926 A 9/1988 Meyers
5,146,698 A * 9/1992 Tilles ..... A43B 7/144 36/43

(Continued)

FOREIGN PATENT DOCUMENTS

CA 2631392 A1 11/2008
CN 102754962 A 10/2012

(Continued)

*Primary Examiner* — Ted Kavanaugh
(74) *Attorney, Agent, or Firm* — Quinn IP Law

(57) ABSTRACT

A sole structure for an article of footwear includes a unitary sole with a first cushioning body having a first hardness and a second cushioning having a second hardness greater than the first hardness. Both the first and the second cushioning bodies are exposed at a periphery of the sole. The second cushioning body may have a wedge surface that interfaces with a lateral extremity of the first cushioning body and angles laterally outward toward a lateral side exterior surface of the sole from a lower extent to an upper extent of the wedge surface. The second cushioning body may underlie the first cushioning body in a portion of a forefoot region of the sole such that the first cushioning body establishes a foot-facing exterior surface and the second cushioning body establishes a ground-facing exterior surface of the sole where the first cushioning body overlies the second cushioning body.

16 Claims, 7 Drawing Sheets

Related U.S. Application Data

(60) Provisional application No. 62/575,922, filed on Oct. 23, 2017.

(51) Int. Cl.

| | |
|---|---|
| ***A43B 13/12*** | (2006.01) |
| ***A43B 7/142*** | (2022.01) |
| ***A43B 7/144*** | (2022.01) |
| ***A43B 13/04*** | (2006.01) |
| ***A43B 7/143*** | (2022.01) |
| ***A43B 17/02*** | (2006.01) |

(52) U.S. Cl.

CPC ..... *A43B 13/04* (2013.01); *A43B 13/12* (2013.01); *A43B 13/16* (2013.01); *A43B 13/188* (2013.01); *A43B 17/02* (2013.01)

(56) References Cited

U.S. PATENT DOCUMENTS

| | | | | |
|---|---|---|---|---|
| 5,542,196 | A * | 8/1996 | Kantro | A43B 17/00 36/181 |
| 7,082,704 | B2 * | 8/2006 | Throneburg | A43B 17/18 36/31 |
| 7,526,882 | B2 * | 5/2009 | Rhenter | A43B 7/1445 36/43 |
| 10,932,522 | B2 * | 3/2021 | Kurcinka | A43B 13/12 |
| 2003/0192202 | A1 * | 10/2003 | Schoenborn | A43B 7/143 36/31 |
| 2003/0200678 | A1 * | 10/2003 | Nishiwaki | A43B 7/1425 36/28 |
| 2006/0080863 | A1 * | 4/2006 | Pai | A43B 17/03 36/28 |
| 2008/0086909 | A1 * | 4/2008 | Raspini | A43B 7/145 36/44 |
| 2015/0282561 | A1 * | 10/2015 | Swager Van Dok | A43B 13/127 36/31 |

FOREIGN PATENT DOCUMENTS

| | | | |
|---|---|---|---|
| CN | 102917612 | A | 2/2013 |
| CN | 103976503 | A | 8/2014 |
| CN | 105025746 | A | 11/2015 |
| CN | 105167320 | A | 12/2015 |
| CN | 204888908 | U | 12/2015 |
| WO | 2012012122 | A2 | 1/2012 |
| WO | 2016136381 | A1 | 11/2017 |

* cited by examiner

DROP-IN UNITARY FOOTWEAR SOLE WITH FIRST AND SECOND CUSHIONING BODIES OF DIFFERING HARDNESS

CROSS-REFERENCE TO RELATED APPLICATION

This is a continuation of, and claims priority to, U.S. patent application Ser. No. 16/167,677 filed Oct. 23, 2018, which claims the benefit of priority to U.S. Provisional Application No. 62/575,922 filed Oct. 23, 2017, each of which is hereby incorporated by reference in its entirety.

TECHNICAL FIELD

The present disclosure generally includes a sole structure for an article of footwear.

BACKGROUND

Footwear typically includes a sole structure configured to be located under a wearer's foot to space the foot away from the ground. Sole structures in athletic footwear are configured to provide one or more of desired cushioning, motion control, and resiliency.

DESCRIPTION

Figure 1:
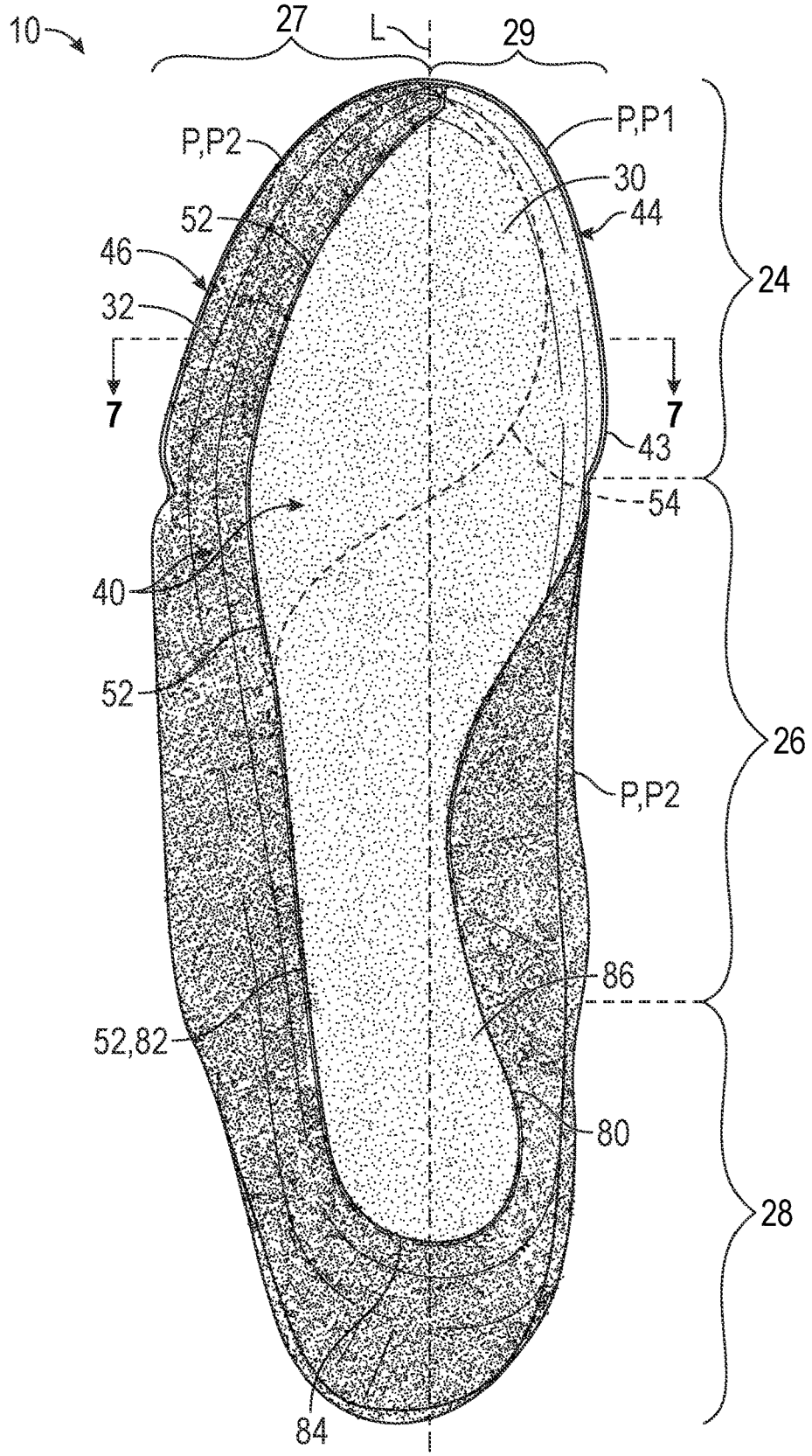
FIG. 1 is a schematic illustration in plan view of a midsole in accordance with the present disclosure.

A sole structure for an article of footwear comprises a unitary sole for insertion into a foot-receiving cavity of the article of footwear. The unitary sole has a forefoot region, a midfoot region, and a heel region. Stated differently, the unitary sole is a full-length sole. The unitary sole provides cushioning, and is configured as a "drop-in" unitary sole that is removably insertable into the foot-receiving cavity of the article of footwear through an ankle opening of the article of footwear. Accordingly, the unitary sole is configured to function as a both a midsole and as an insole. The unitary sole is generally referred to herein as a midsole, but may also be referred to as an insole or as a unisole.

The unitary sole comprises a first cushioning body and a second cushioning body. The first cushioning body has a first hardness, and the second cushioning body has a second hardness greater than the first hardness. For example, the hardness of the first cushioning body may be but is not limited to from about 5 durometer to about 15 durometer greater than the hardness of the second cushioning body. The first cushioning body may comprise and be formed from a first foam material, and the second cushioning body may comprise and be formed from a second foam material different than the first foam material.

Both the first cushioning body and the second cushioning body are exposed at a periphery of the unitary sole. The periphery of the unitary sole is at the exterior surface of the unitary sole, and a cushioning body is exposed at the periphery if it forms a portion of the exterior surface of the unitary sole. Stated differently, even the softer first cushioning body forms a portion of the exterior surface of the unitary sole. For example, in an aspect of the disclosure, only the first cushioning body is exposed along a first portion of the periphery, and the second cushioning body is exposed along a remainder of the periphery. The first portion of the periphery at which the first cushioning body is exposed may be a medial side exterior surface of the unitary sole in the forefoot region.

In an aspect of the disclosure, the first cushioning body may include a first upwardly-extending flange at the first portion of the periphery, and the second cushioning body may include a second upwardly-extending flange at a second portion of the periphery. The first upwardly-extending flange and the second upwardly-extending flange partially define a footbed recess at the foot-facing exterior surface.

Both the first cushioning body and the second cushioning body may each be continuous configurations that extend in the forefoot region, in the midfoot region, and in the heel region, with some portions of the first and second cushioning bodies layered in the vertical direction with respect to one another, and at some other portions, only the first cushioning body or only the second cushioning body forming the entire thickness of the unitary sole without vertical layering. In a lateral direction as well (i.e., perpendicular to the vertical direction and to the longitudinal midline of the unitary sole), the first and second cushioning bodies may be juxtaposed differently at different portions. This enables the different hardnesses of the first and second cushioning bodies to be used advantageously alone or together to react vertical and lateral loads of the foot on the unitary sole.

For example, in an aspect of the disclosure, the second cushioning body underlies a portion of the first cushioning body in the forefoot region and establishes a ground-facing exterior surface of the unitary sole in the forefoot region under the portion of the first cushioning body.

The first cushioning body may have a continuous configuration that extends along a foot-facing exterior surface of the unitary sole from the first portion of the periphery in the forefoot region, through the midfoot region and into the heel region, and that also extends along the ground-facing exterior surface of the unitary sole from the first portion of the periphery in the forefoot region, through the midfoot region and into the heel region.

The first cushioning body may have a lateral extremity between a longitudinal midline of the unitary sole and a lateral side exterior surface of the unitary sole at the foot-facing exterior surface in the forefoot region, and the second cushioning body may extend from the lateral side exterior surface of the unitary sole to the lateral extremity of the first cushioning body at the foot-facing exterior surface in the forefoot region.

The second cushioning body may have a medial extremity between the longitudinal midline and the medial side exterior surface of the unitary sole at the ground-facing exterior surface in the forefoot region, and the first cushioning body may extend from the medial side exterior surface of the unitary sole to the medial extremity of the second cushioning body at the ground-facing exterior surface in the forefoot region. The lateral extremity of the first cushioning body at the foot-facing exterior surface may be nearer the lateral side exterior surface of the unitary sole than is the medial extremity of the second cushioning body at the ground-facing exterior surface. The first cushioning body may overlie the second cushioning body between the medial extremity of the second cushioning body and the lateral extremity of the first cushioning body in the forefoot region.

The second cushioning body may have a wedge surface that interfaces with the first cushioning body at the lateral extremity of the first cushioning body. For example, the wedge surface may angle upward and laterally outward toward a lateral side exterior surface of the unitary sole from a lower interior surface of the first cushioning body overlaying the second cushioning body to the foot-facing exterior surface of the unitary sole. By way of non-limiting example, an angle between the wedge surface and the vertical axis may be from about 5 degrees to about 45 degrees. At angles within such a range, the wedge surface is subjected to various loads that extend downward and/or laterally outward, thereby allowing the harder, second cushioning body to react such loads. The wedge surface may extend along the lateral extremity of the first cushioning body in one or more of the forefoot region, the midfoot region, and the heel region. The angle between the wedge surface and the vertical axis may vary as the wedge surface extends along the lateral extremity. For example, the angle may be different in the forefoot region than in the midfoot region or than in the heel region.

The first cushioning body may have an interior surface that interfaces with an interior surface of the second cushioning body at the medial extremity of the second cushioning body in the forefoot region. The interior surface of the first cushioning body may extend vertically, may angle laterally outward and downward relative to a vertical axis (i.e., sloping downward and toward the medial side exterior surface of the unitary sole) from an upper interior surface of the second cushioning body underlying the first cushioning body to the ground-facing exterior surface of the unitary sole, or may angle laterally inward relative to a vertical axis (i.e., sloping downward and away from the medial side exterior surface of the unitary sole) from the upper interior surface of the second cushioning body underlying the first cushioning body to the ground-facing exterior surface of the unitary sole.

In an aspect of the disclosure, the first cushioning body may extend from the foot-facing exterior surface to the ground-facing exterior surface in the midfoot region and in the heel region, and may be bordered by the second cushioning body extending from the foot-facing exterior surface to the ground-facing exterior surface at a periphery of the first cushioning body in the midfoot region and in the heel region. Accordingly, in such an embodiment, the first cushioning body is centrally located in the midfoot region and in the heel region, and the second cushioning body wraps laterally and around an exterior (e.g., a side and rear exterior) of the first cushioning body in the midfoot region and the heel region.

The first cushioning body and the second cushioning body may have complex, three-dimensional configurations that interfit with one another in different vertical and lateral arrangements in the different regions of the unitary sole, but may still be flush with one another where they abut at the exterior surface of the unitary sole, including the foot-facing exterior surface, the ground-facing exterior surface, the medial side exterior surface, and the lateral side exterior surface.

In an aspect of the disclosure, an article of footwear comprises an outsole, an upper, and a unitary, full-length midsole. The upper is secured to the outsole and defines a foot-receiving cavity and an ankle opening. The unitary, full-length midsole has a forefoot region, a midfoot region, and a heel region, and is configured to be removably inserted into the foot-receiving cavity through the ankle opening. The midsole comprises a first cushioning body having a first hardness, and a second cushioning body having a second hardness greater than the first hardness. The second cushioning body underlies the first cushioning body in a portion of a forefoot region of the midsole such that the first cushioning body establishes a foot-facing exterior surface of the midsole and the second cushioning body establishes a ground-facing exterior surface of the midsole where the first cushioning body overlies the second cushioning body. The first cushioning body establishes both the foot-facing exterior surface of the midsole and the ground-facing exterior surface of the midsole in a central portion of the heel region of the midsole.

In an aspect of the disclosure, the first cushioning body is exposed at a periphery of the midsole at a medial side exterior surface of the midsole in the forefoot region, and the second cushioning body is exposed at the periphery of the midsole at a lateral side exterior surface of the midsole in the forefoot region. When the midsole is inserted into the foot-receiving cavity, the first cushioning body and the second cushioning body remain exposed at the exterior surfaces of the midsole (e.g., forming the exterior surfaces) as described, although in some embodiments they may not be exposed to view unless perhaps by looking down into the foot-receiving cavity from the ankle opening.

In an aspect of the disclosure, the second cushioning body has a wedge surface that interfaces with a lateral extremity of the first cushioning body. The wedge surface angles upward and laterally outward (i.e., sloping upward and toward a lateral side exterior surface of the midsole from a lower extent of the wedge surface to an upper extent of the wedge surface).

The above features and advantages and other features and advantages of the present disclosure are readily apparent from the following detailed description of the modes for carrying out the present disclosure when taken in connection with the accompanying drawings.

Figure 10:
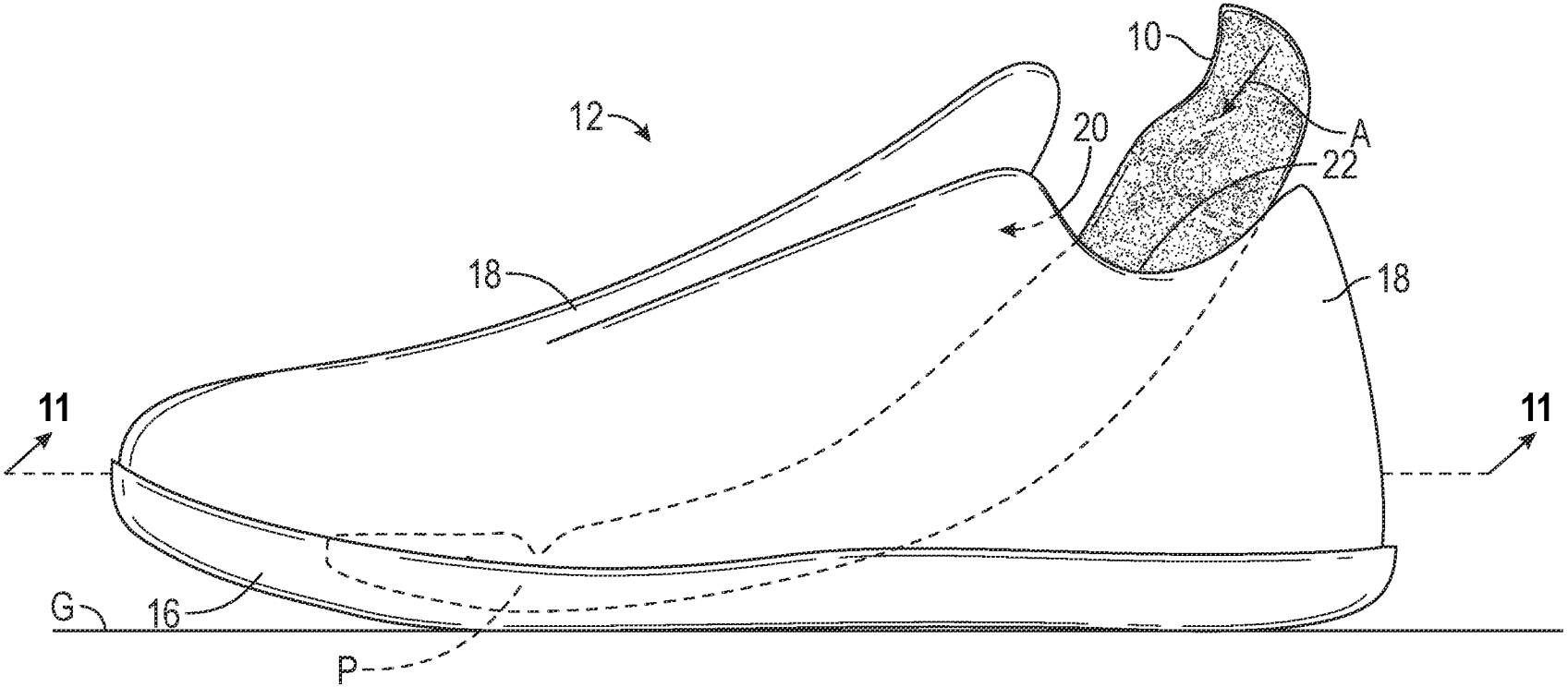
FIG. 10 is a schematic illustration in lateral side view of an article of footwear showing the midsole of FIG. 1 being inserted into a foot-receiving cavity.
Figure 11:
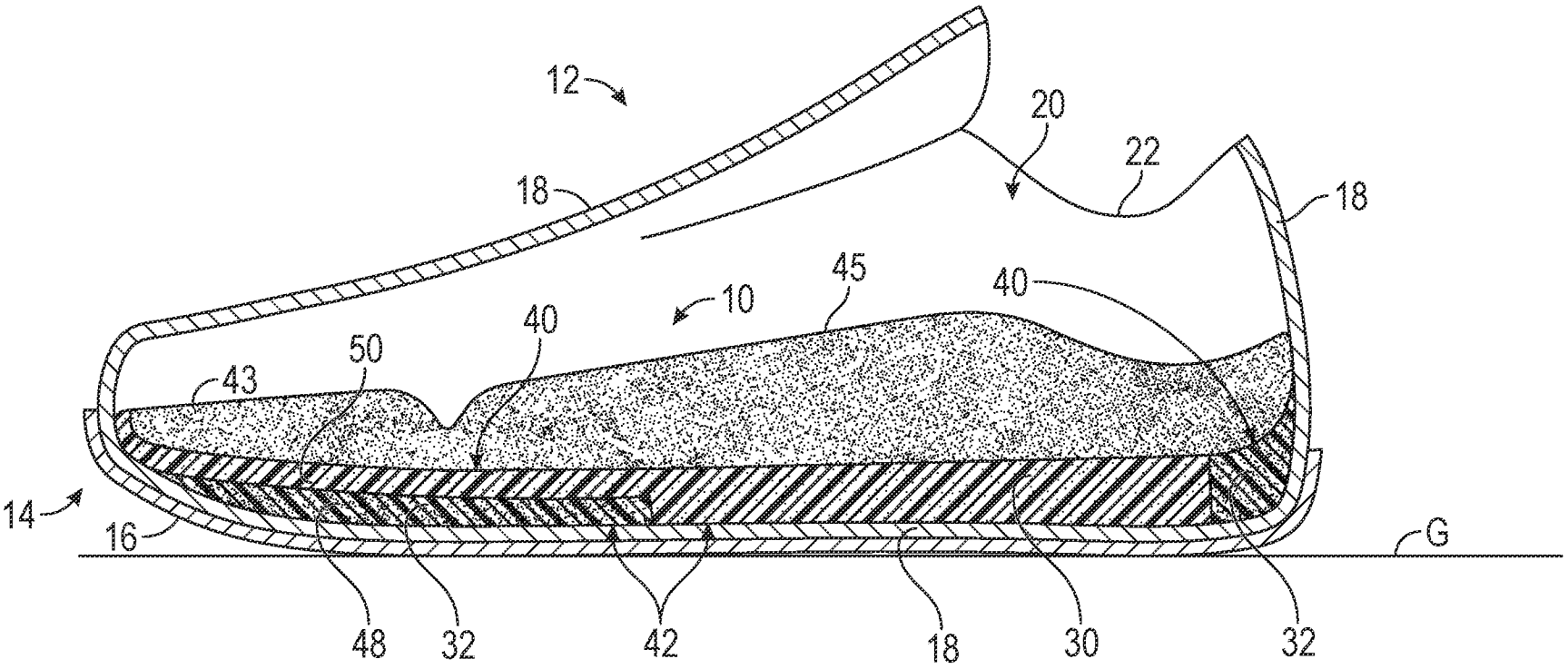
FIG. 11 is a schematic illustration in cross-sectional view of the article of footwear of FIG. 10 taken at lines 11-11 in FIG. 10 with insertion of the midsole complete.

Referring to the drawings, wherein like reference numbers refer to like components throughout the views, FIG. 1 shows a unitary sole 10 for an article of footwear 12, which is shown in FIGS. 10 and 11. The unitary sole 10 is also referred to herein simply as sole 10, and because the unitary sole 10 is configured to function as both a midsole and as an insole, it may be referred to herein as a midsole, an insole, or as a unisole. The article of footwear 12 may also be referred to simply as footwear 12. The sole 10 is part of the sole structure 14 of the article of footwear 12. The sole structure 14 also includes an outsole 16 that is secured to an upper 18. The upper 18 defines a foot-receiving cavity 20 and an ankle opening 22.

Referring to FIG. 1, the sole 10 may be divided into three general regions: a forefoot region 24, a midfoot region 26, and a heel region 28 which support respective regions of a foot resting on the sole 10. As such, the sole 10 may be referred to as a full-length sole, and is a unitary, full-length midsole. The forefoot region 24 generally includes portions of the sole 10 corresponding with the toes and the metatarsophalangeal joints connecting the metatarsals with the phalanges. The midfoot region 26 generally includes portions of the sole 10 corresponding with the arch area of the foot, and the heel region 28 includes portions of the sole 10 corresponding with rear portions of the foot, including the calcaneus bone.

The sole 10 has a longitudinal midline LM that extends fore-aft from the forefoot region 24 to the heel region 28. Portions of the sole 10 disposed between the longitudinal midline LM and a lateral side exterior surface 46 of the sole 10 may be considered the lateral side 27 of the sole 10. Portions of the sole 10 disposed between the longitudinal midline LM and a medial side exterior surface 44 may be considered a medial side 29 of the sole 10.

The forefoot region 24, the midfoot region 26, the heel region 28, the lateral side 27 and the medial side 29 are not intended to demarcate precise areas of the sole 10, but are instead intended to represent general areas of sole 10 to aid in the following discussion. In addition to the sole 10, the relative locations of the forefoot region 24, the midfoot region 26, and the heel region 28, lateral side 27 and medial side 29 may also be applied to the outsole 16, and the upper 18, and other components and individual elements thereof.

The sole 10 is configured to be removably inserted into the foot-receiving cavity 20 through the ankle opening 22. In FIG. 10, the sole 10 is shown in the process of being inserted into the foot-receiving cavity 20, and is being directed therein in the direction of arrow A. The sole 10 is thus referred to as a "drop-in" midsole. The sole 10 is supported by the outsole 16 and may rest on a lower portion of the upper 18 if the upper 18 wraps under the foot, as shown in FIG. 11. As shown in FIG. 10, sidewalls of the outsole 16 may extend upward and be disposed laterally outward of the periphery P of the sole 10 to provide support around the entire periphery of the sole 10. However, the sole 10 is not permanently secured to the outsole 16, to the upper 18, or to any other component within the foot-receiving cavity 20 such as by adhesive or otherwise, and as such may be removed from the foot-receiving cavity 20 without damage to the article of footwear 12 by lifting the sole 10 at the heel region 28, and withdrawing the sole 10 through the ankle opening 22.

The sole 10 is configured to cushion a foot of a wearer of the article of footwear 12, reacting loading forces of the foot when positioned between the foot and the ground G. More specifically, the sole 10 includes a first cushioning body 30 and a second cushioning body 32. In the drawings, the first cushioning body 30 is depicted with generally lighter shading than the second cushioning body 32 to readily differentiate the bodies 30, 32. The first cushioning body 30 has a first hardness, and the second cushioning body 32 has a second hardness greater than the first hardness. For example, the hardness of the first cushioning body 30 may be but is not limited to from about 5 durometer to about 15 durometer greater than the hardness of the second cushioning body 32, such as on a Shore A, a Shore D, or an Asker C hardness scale. The first and second cushioning bodies 30, 32 may be formed from the same material but with different densities to achieve the different hardnesses, or may be formed from different materials. In the embodiment shown, the first cushioning body 30 comprises and is formed from a first foam material, and the second cushioning body 32 comprises and is formed from a second foam material different than the first foam material. Example foam materials from which the first and second cushioning bodies 30, 32 may be formed include a thermoplastic polymer foam or a thermoset polymer foam. By way of non-limiting example, the first foam material and the second foam material may each be any of: a polyurethane (PU) foam (also referred to as a PU-based foam); an ethylene-vinyl acetate (EVA) foam (also referred to as an EVA-based foam), which in some embodiments may include heat-expanded and molded EVA foam pellets; or combinations of an EVA foam and rubber; foams referred to as phylon, phylite, of cushlon; or other foams, with the resulting second cushioning body being harder than the first cushioning body.

Both the first cushioning body 30 and the second cushioning body 32 are each of continuous configurations that extend in the forefoot region 24, the midfoot region 26, and the heel region 28. The first and second cushioning bodies 30, 32 may be injection molded or otherwise formed together so that the sole 10 is a unitary (i.e., one-piece) component comprised of the two cushioning bodies 30, 32. The first cushioning body 30 and the second cushioning body 32 have complex, three-dimensional configurations that interfit with one another in different vertical and lateral arrangements in the different regions of the sole 10. This enables the first and second cushioning bodies 30, 32 with their different hardnesses to be used advantageously alone or together to react vertical and lateral loads of the foot. The first and second cushioning bodies 30, 32 are flush with one another at their respective extremities at the exterior surfaces of the sole 10 where they abut one another, including at a foot-facing exterior surface 40, a ground-facing exterior surface 42, a medial side exterior surface 44, and a lateral side exterior surface 46.

Figure 2:
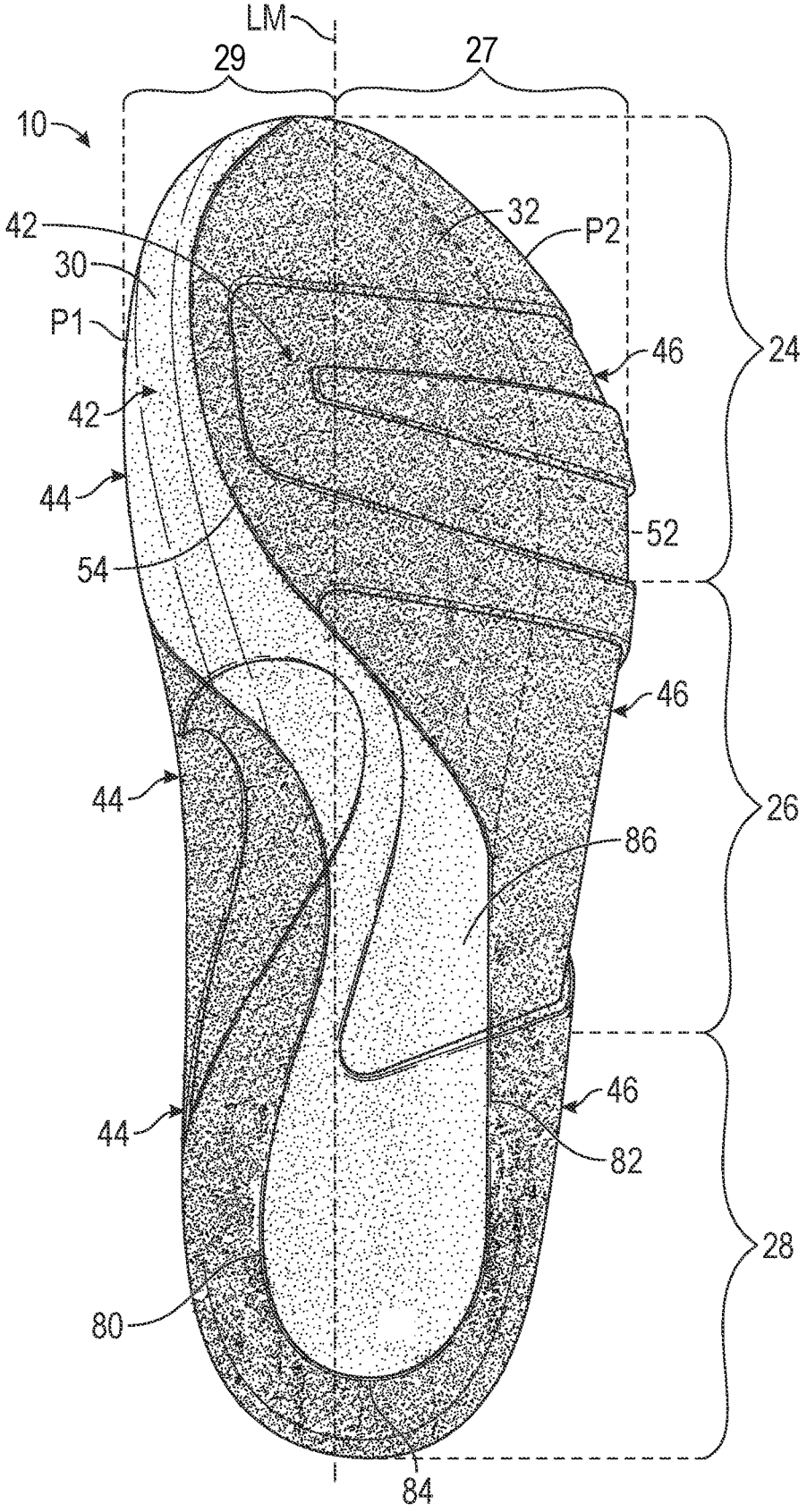
FIG. 2 is a schematic illustration in bottom view of the midsole of FIG. 1.
Figure 7:
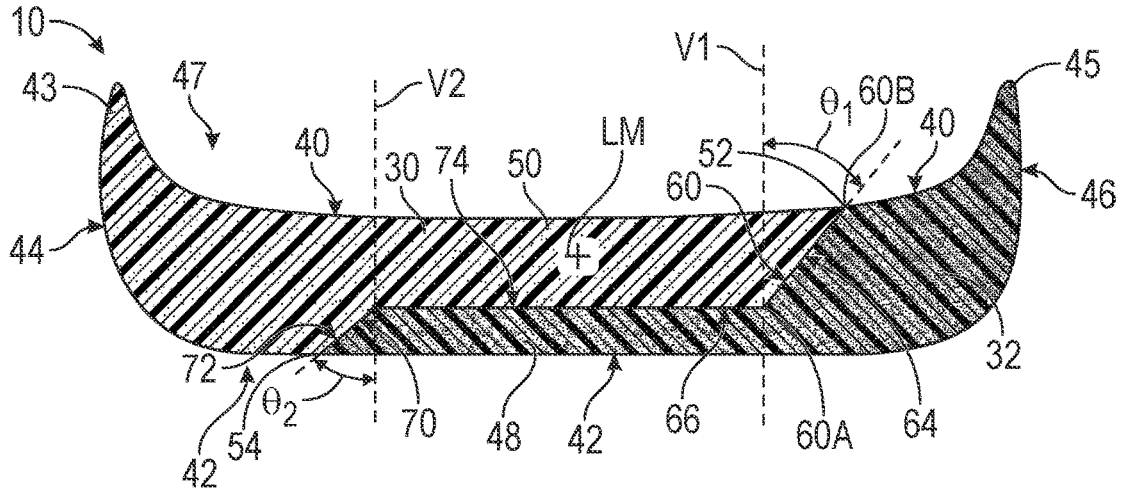
FIG. 7 is a schematic cross-sectional illustration of the midsole of FIG. 1 taken at lines 7-7 in FIG. 1.

With reference to FIGS. 1 and 2, only some portions of the first and second cushioning bodies 30, 32 are layered in the vertical direction with respect to one another. For example, as shown in FIG. 7 in the forefoot region 24, a portion 48 of the second cushioning body 32 underlies a portion 50 of the first cushioning body 30 and establishes the ground-facing exterior surface 42 of the sole 10 in the forefoot region 24 where it directly underlies the portion 50 of the first cushioning body 30. The vertically-stacked configuration of the portions 48, 50 may lend different cushioning properties to different regions of the sole 10, such as a different resiliency or stiffness relative to a portion in which the softer first cushioning body 30 occupies the entire thickness of the sole 10 from the foot-facing exterior surface 40 (as shown in FIG. 1) to the ground-facing exterior surface 42 (as shown in FIG. 2), and relative to a portion in which the harder second cushioning body 32 occupies the entire thickness of the sole 10 from the foot-facing exterior surface 40 to the ground-facing exterior surface 42.

Figure 3:
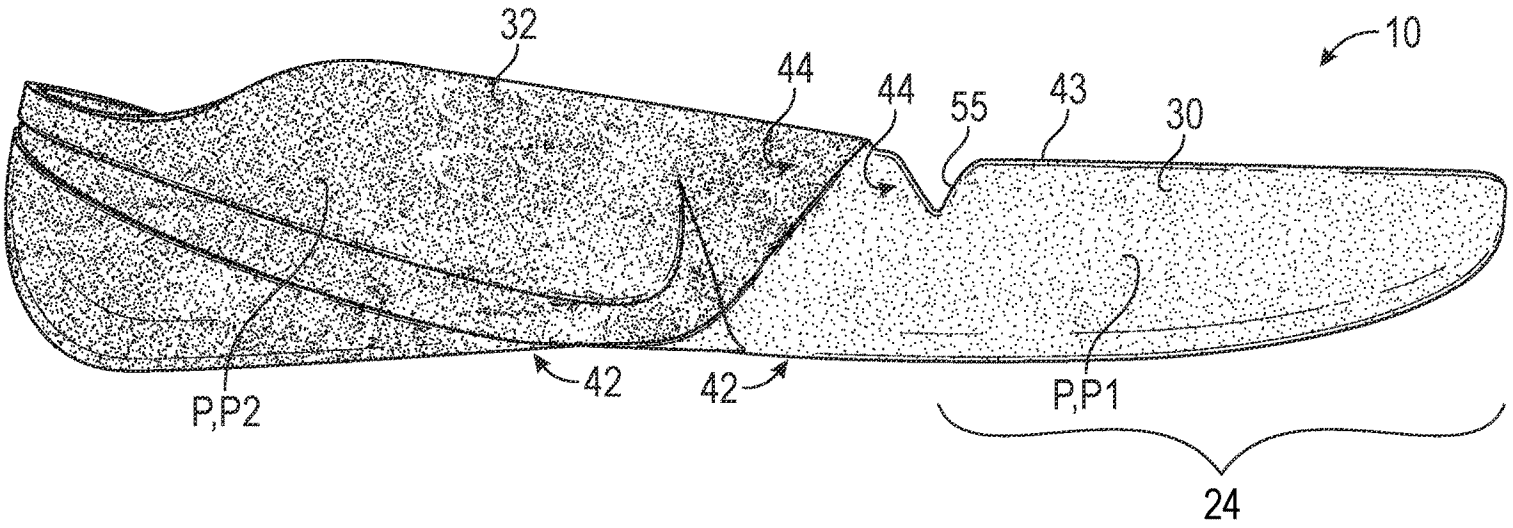
FIG. 3 is a schematic illustration in medial side view of the midsole of FIG. 1.

Both the first cushioning body 30 and the second cushioning body 32 are exposed at a periphery P of the sole 10. For example, as best shown in FIG. 3, only the first cushioning body 30 is exposed along a first portion P1 of the periphery P at the medial side exterior surface 44 of the sole 10 in the forefoot region 24. Stated differently, even the softer first cushioning body 30 forms a portion of the exterior surface of the sole 10. The first cushioning body 30 is also exposed at and forms a portion of the foot-facing exterior surface 40 and the ground-facing exterior surface 42, as does the second cushioning body 32.

Figure 4:
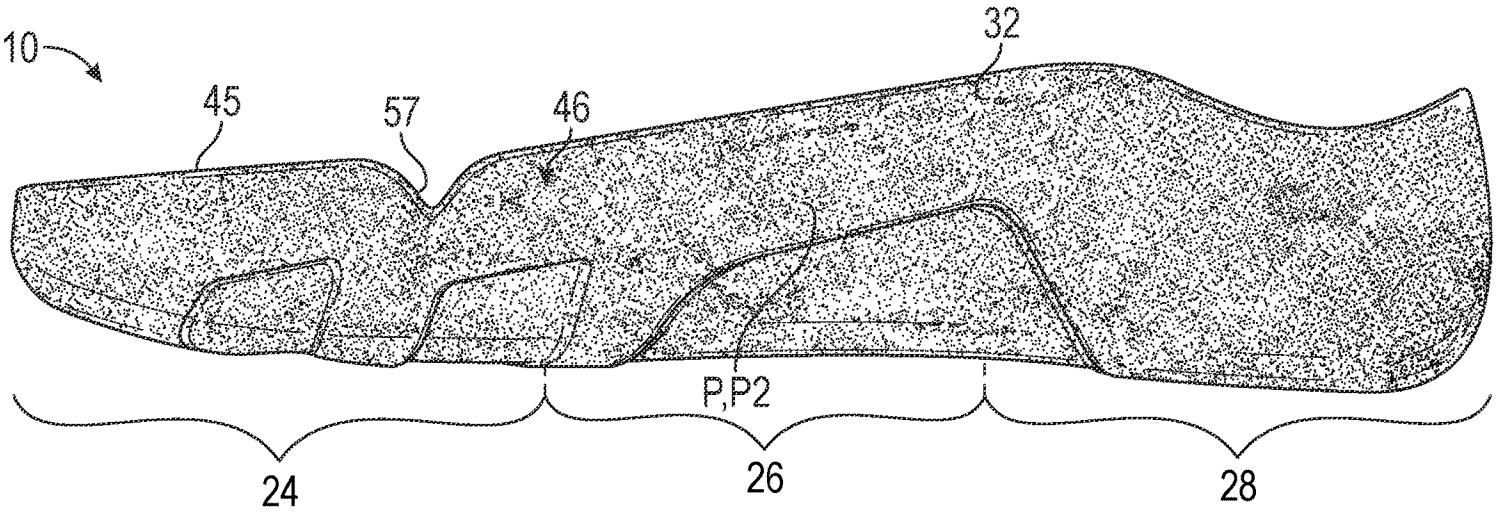
FIG. 4 is a schematic illustration in lateral side view of the midsole of FIG. 1.

The second cushioning body 32 is exposed along a remainder P2 of the periphery P as shown in FIGS. 3 and 4. The remainder P2 may also be referred to as a second portion P2 of the periphery P. The first and second portions P1, P2 may together form the entire periphery P. The second portion P2 is more extensive than the first portion P1, so that the harder second cushioning body 32 covers a greater extent of the exterior side surfaces 44, 46 than does the first cushioning body 30. The second cushioning body 32 forms the entire lateral exterior side surface 46 in order to provide a greater stiffness at the lateral side 27 of the sole 10 than if the first cushioning body 30 were disposed at the lateral exterior side surface 46.

Figure 6:
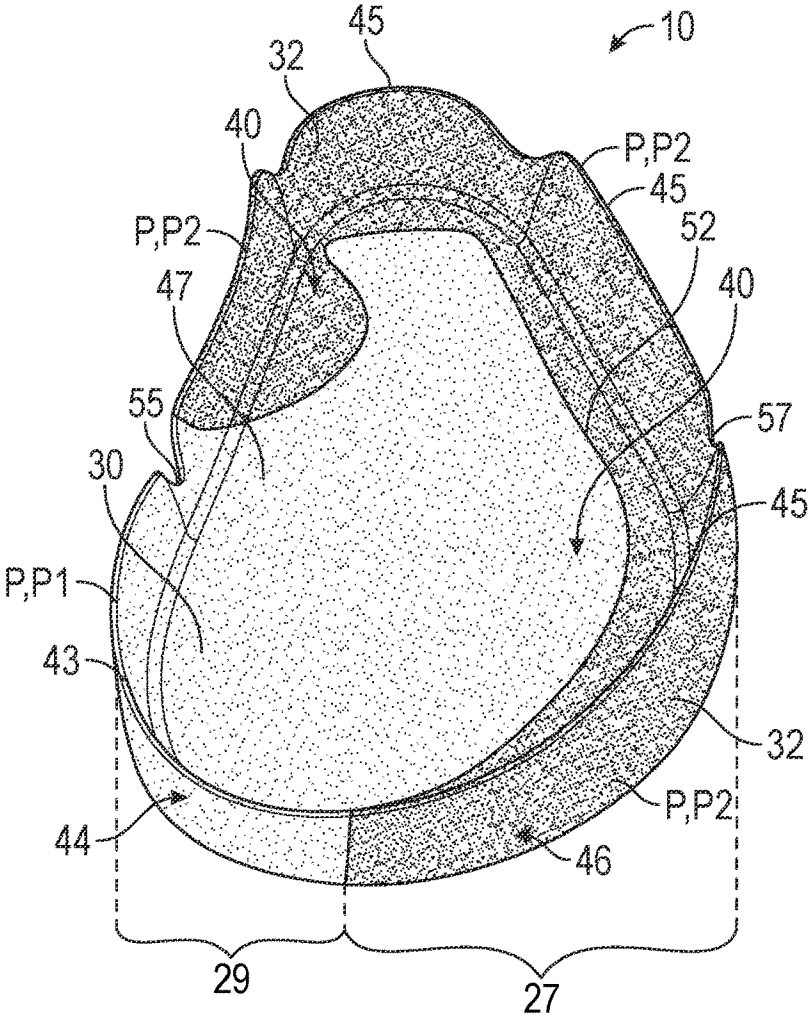
FIG. 6 is a schematic illustration in another front perspective view of the midsole of FIG. 1.
Figure 5:
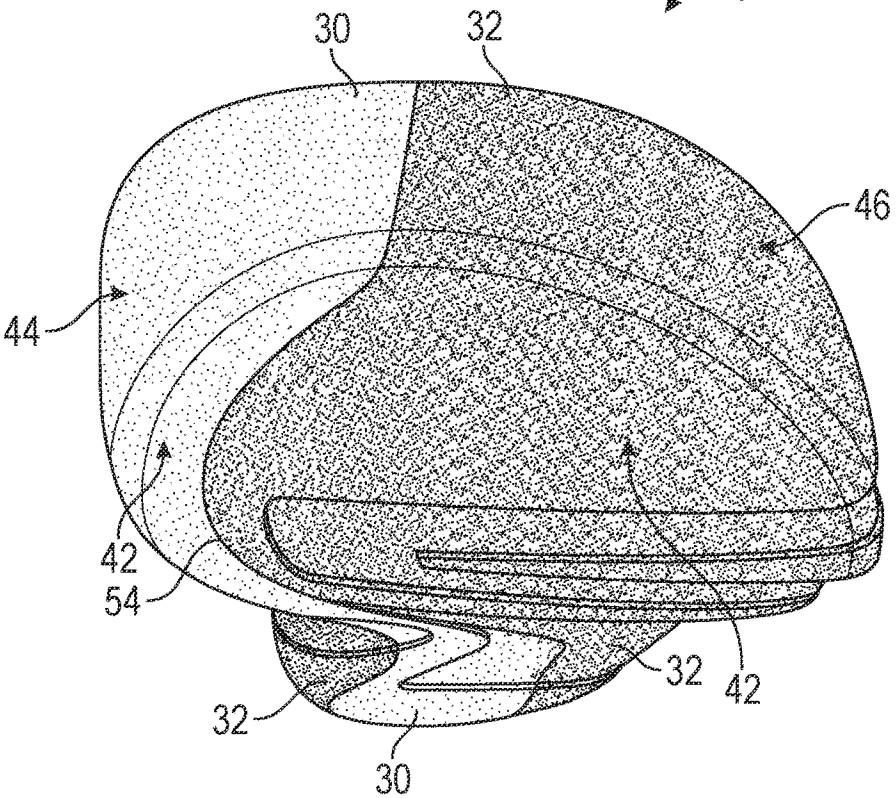
FIG. 5 is a schematic illustration in front perspective view of the midsole of FIG. 1.

As best shown in FIG. 6, the first cushioning body 30 includes a first upwardly-extending flange 43 at the first portion P1 of the periphery P. The second cushioning body 32 includes a second upwardly-extending flange 45 at the second portion P2 of the periphery P. The first upwardly-extending flange 43 and the second upwardly-extending flange 45 partially defining a footbed recess 47 at the foot-facing exterior surface 40 in the forefoot region 24 as best shown in FIG. 7. The second upwardly-extending flange 45 generally continues around the entire remainder (i.e., the second portion P2) of the periphery P, including in the midfoot region 26 and the heel region 28, as best shown in FIG. 6. The flanges 43, 45 together surround the entire foot-facing exterior surface 40 to cup or nest a foot in the footbed recess 47. The harder material of the second cushioning body 32 bears lateral loading of the flange 45 on the lateral side 27 of the sole 10. The flange 43 has a medial notch 55, and the flange 45 has a lateral notch 57. Both of the notches 55, 57 are generally disposed adjacent to the metatarsophalangeal joints of a foot in the forefoot region 24 to promote flexibility and ease of dorsiflexion.

The first cushioning body 30 has a continuous configuration that extends along the foot-facing exterior surface 40 of the sole 10 from the first portion P1 of the periphery in the forefoot region 24, through the midfoot region 26 and into the heel region 28, as best shown in FIG. 1. The continuous configuration of the first cushioning body 30 is also such that the first cushioning body 30 extends along the ground-facing exterior surface 42 of the sole 10 from the first portion P1 of the periphery in the forefoot region 24, through the midfoot region 26 and into the heel region 28, as best shown in FIG. 2. The ground-facing exterior surface 42 and the medial side exterior surface 44 of the first cushioning body 30 may have a surface texture (not shown). Additionally, the sole 10 may include grooves, recesses, and protrusions that help increase flexibility of the sole 10, such as the laterally-extending grooves shown in the forefoot region 24 in the bottom view of FIG. 2.

With reference to FIG. 1, the first cushioning body 30 has a lateral extremity 52 between the longitudinal midline LM of the sole 10 and the lateral side exterior surface 46 of the sole 10 at the foot-facing exterior surface 40 in the forefoot region 24. The lateral extremity 52 also extends through the midfoot region 26 and the heel region 28 at the foot-facing exterior surface 40. The second cushioning body 32 extends from the lateral side exterior surface 46 to the lateral extremity 52 of the second cushioning body 32 at the foot-facing exterior surface 40 in the forefoot region 24, and in the midfoot region 26 and the heel region 28, as shown in FIG. 1.

The second cushioning body 32 has a medial extremity 54 between the longitudinal midline LM and the medial side exterior surface 44 of the sole 10 at the ground-facing exterior surface 42 in the forefoot region 24 as shown in FIG. 2. The medial extremity 54 also extends through the midfoot region 26 and the heel region 28 at the ground-facing exterior surface 42. The first cushioning body 30 extends from the medial side exterior surface 44 of the sole 10 to the medial extremity 54 of the second cushioning body 32 at the ground-facing exterior surface 42 in the forefoot region 24 and extends in the midfoot region 26 and the heel region 28. At least in the forefoot region 24, the lateral extremity 52 of the first cushioning body 30 at the foot-facing exterior surface 40 is nearer the lateral side exterior surface 46 of the sole 10 than is the medial extremity 54 of the second cushioning body 32 at the ground-facing exterior surface 42, as can be seen by a comparison of the lateral extremity 52 and the medial extremity 54 (shown with hidden lines) in FIG. 1.

Similarly, at least in the forefoot region 24, the medial extremity 54 of the second cushioning body 32 at the ground-facing exterior surface 42 is nearer the medial side exterior surface 44 of the sole 10 than is the lateral extremity 52 of the first cushioning body 30 at the foot-facing exterior surface 40, as can be seen in FIG. 2 by a comparison of the lateral extremity 52 (shown with hidden lines) and the medial extremity 54.

Between the medial extremity 54 of the second cushioning body 32 and the lateral extremity 52 of the first cushioning body 30 in the forefoot region 24, the first cushioning body 30 overlies the second cushioning body 32 (e.g., at portion 50 of the first cushioning body 30 and portion 48 the second cushioning body 32, as described with respect to FIG. 7).

In a lateral direction (e.g., a transverse direction perpendicular to the longitudinal midline LM), the first and second cushioning bodies 30, 32 may be juxtaposed differently at different portions or regions. For example, as shown in FIG. 7, the second cushioning body 32 has a wedge surface 60 that interfaces with a surface 64 of the first cushioning body 30 at the lateral extremity 52 of the first cushioning body 30. The wedge surface 60 angles laterally outward and upward (relative to a vertical axis V1 disposed at the intersection of the wedge surface 60 and a lower interior surface 66) from the lower interior surface 66 of the portion 50 of the first cushioning body 30 overlaying the portion 48 of the second cushioning body 32 to the foot-facing exterior surface 40 of the sole 10. Stated differently, the wedge surface 60 angles laterally upward and outward toward the lateral side exterior surface 46 from a lower extremity 60A of the wedge surface 60 to an upper extremity 60B of the wedge surface 60. By way of non-limiting example, an angle $\theta_1$ of the wedge surface 60 to the vertical axis V1 may be from about 5 degrees to about 45 degrees. Angles within such a range allow the wedge surface 60 to be normal to various downward and laterally-outward directed loads, thereby allowing the harder, second cushioning body 32 to react such loads. For example, during certain activities, such as a lateral cutting move during basketball, the wedge surface 60 may react such loads and thereby provide increased lateral support.

The wedge surface 60 may extend along the lateral extremity 52 of the first cushioning body 30 in the forefoot region 24, the midfoot region 26, and the heel region 28. The angle $\theta_1$ of the wedge surface 60 to the vertical axis V1 may vary as the wedge surface 60 extends along the lateral extremity 52. For example, the angle $\theta_1$ may be different in the forefoot region 24, than in the midfoot region 26 or than in the heel region 28.

With further reference to FIG. 7, the first cushioning body 30 has an interior surface 70 that interfaces with an interior surface 72 of the second cushioning body 32 at the medial extremity 54 of the second cushioning body 32 in the forefoot region 24. The interior surface 70 may angle laterally outward and downward relative to a vertical axis V2 (i.e., generally downward and toward the medial side exterior surface 44 of the sole 10) from an upper interior surface 74 of the portion 48 of the second cushioning body 32 underlying the portion 50 of the first cushioning body 30, to the ground-facing exterior surface 42. By way of non-limiting example, an angle $\theta_2$ between the interior surface 70 and the vertical axis V2 may be from about 5 degrees to about 45 degrees.

Figure 8:
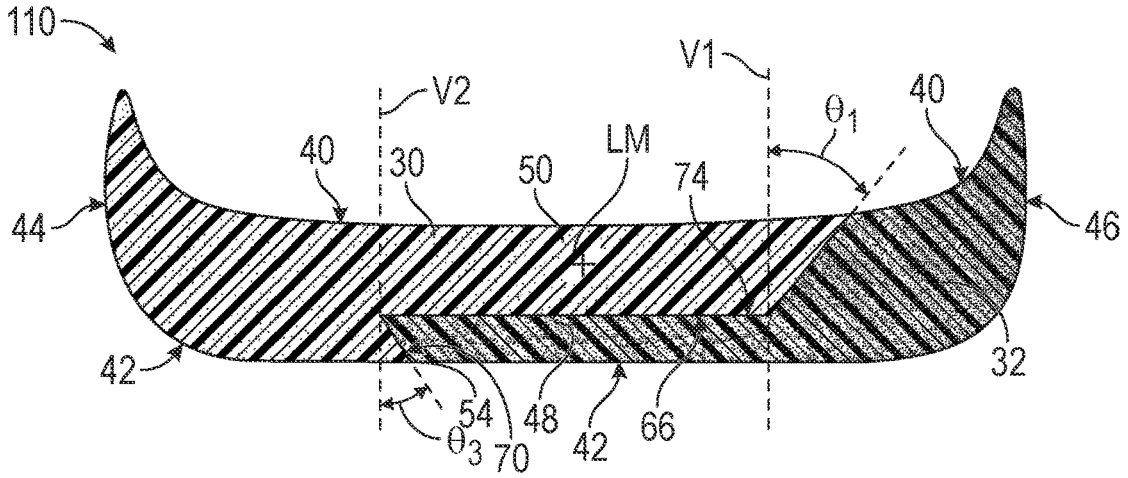
FIG. 8 is a schematic cross-sectional illustration of an alternative embodiment of a midsole within the scope of the present disclosure.

With reference to FIG. 8, in another alternative embodiment of a sole 110 within the scope of the present disclosure that may be used as an alternative to sole 10 as a drop-in midsole in the article of footwear 12, the interior surface 70 may angle laterally inward relative to the vertical axis V2 (i.e., generally downward and away from the medial side exterior surface 44 of the sole 110) from the upper interior surface 74 of the portion 48 of the second cushioning body 32 underlying the portion 50 of the first cushioning body 30 to the ground-facing exterior surface 42 of the sole 110. By way of non-limiting example, an angle $\theta_3$ between the interior surface 70 of the first cushioning body 30 of the sole 110 and the vertical axis V2 extending at the intersection of the surface 70 and the surface 66 may be from about 5 degrees to about 45 degrees. The sole 110 is alike in all other aspects to sole 10.

Figure 9:
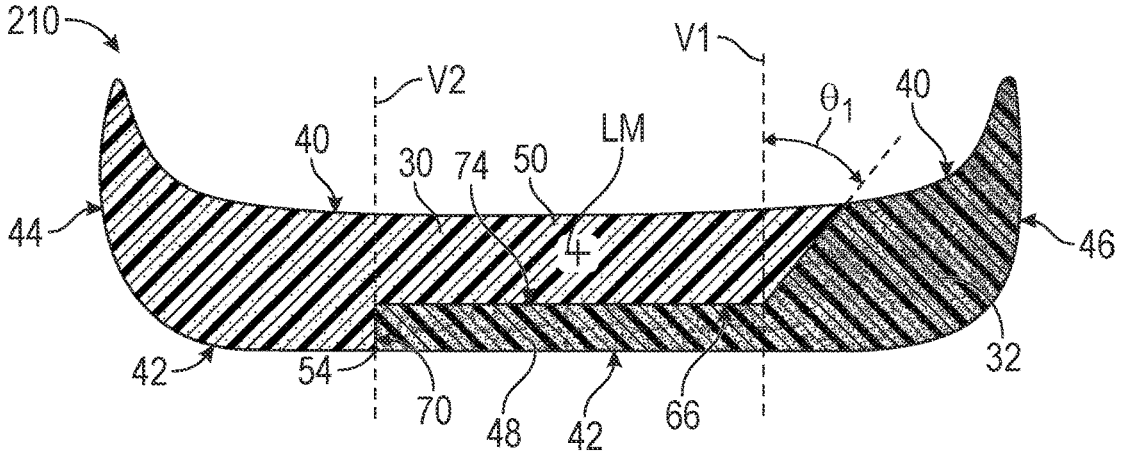
FIG. 9 is a schematic cross-sectional illustration of another alternative embodiment of a midsole within the scope of the present disclosure.

With reference to FIG. 9, in another alternative embodiment of a sole 210 within the scope of the present disclosure that may be used as an alternative to sole 10, the interior surface 70 may extend straight downward from the upper interior surface 74 of the portion 48 of the second cushioning body 32 underlying the portion 50 of the first cushioning body 30 to the ground-facing exterior surface 42 of the sole 110. Stated differently, the interior surface 70 extends along the vertical axis V2 in the sole 210 such that any angle $\theta_2$ or $\theta_3$ as defined with respect to FIGS. 7 and 8, respectively, has a numerical value of zero.

With reference to FIGS. 1 and 2, in other portions of the sole 10 away from the stacked portions 48, 50, either the first cushioning body 30 or the second cushioning body 32 forms the entire thickness of the sole 10 from the foot-facing exterior surface 40 to the ground-facing exterior surface 42 (e.g., without any vertical layering of the first cushioning body 30 and the second cushioning body 32 in such portions). For example, between the lateral extremity 52 of the first cushioning body 30 and the medial extremity 54 of the second cushioning body 32 in much of the midfoot region 26 and in the heel region 28, the first cushioning body 30 extends from the foot-facing exterior surface 40 to the ground-facing exterior surface 42 and is exposed at both surfaces 40, 42. This portion of the first cushioning body 30 is bordered by the second cushioning body 32, which extends from the foot-facing exterior surface 40 to the ground-facing exterior surface 42 at a periphery of the first cushioning body 30 in the midfoot region 26 and in the heel region 28 (e.g., between the medial extremity 54 and the lateral side exterior surface 46, and also between a medial extremity 80 of the first cushioning body 30 (shown in FIG. 2) and the medial side exterior surface 44).

Accordingly, the first cushioning body 30 is centrally located in the midfoot region 26 and the heel region 28, and the second cushioning body 32 wraps around the medial extremity 80, around a lateral extremity 82, and around a rear 84 of the first cushioning body 30 in the midfoot region 26 and the heel region 28. The lateral extremity 82 of the first cushioning body 30 is close in lateral position to and may coincide with the lateral extremity 52 in the midfoot region 26 and in the heel region 28. The first cushioning body 30 is exposed at the foot-facing exterior surface 40 and at the ground-facing exterior surface 42 in the midfoot region 26 and in the heel region 28. In fact, the first cushioning body 30 alone establishes both the foot-facing exterior surface 40 of the sole 10 and the ground-facing exterior surface 42 of the sole 10 in a central portion 86 of the midfoot region 26 and the heel region 28 of the sole 10, with the central portion 86 being spaced apart from both exterior side surfaces 44, 46 by the second cushioning body 32. At all portions of the sole 10 other than at the stacked portions 48, 50, and the central portion 86, the second cushioning body 32 alone establishes both the foot-facing exterior surface 40 and the ground-facing exterior surface 42.

The following Clauses provide example configurations of a sole structure and an article of footwear disclosed herein.

Clause 1: A sole structure for an article of footwear that has a foot-receiving cavity, the sole structure comprising: a unitary sole configured for insertion into the foot-receiving cavity and having a forefoot region, a midfoot region, and a heel region; wherein the unitary sole comprises a first cushioning body and a second cushioning body, the first cushioning body having a first hardness and the second cushioning body having a second hardness greater than the first hardness; and wherein both the first cushioning body and the second cushioning body are exposed at a periphery of the unitary sole.

Clause 2: The sole structure of Clause 1, wherein only the first cushioning body is exposed along a first portion of the periphery, and the second cushioning body is exposed along a remainder of the periphery.

Clause 3: The sole structure of Clause 2, wherein the first portion of the periphery is at a medial side exterior surface of the unitary sole in the forefoot region.

Clause 4: The sole structure of any of Clauses 1-3, wherein the second hardness is from about 5 durometer to about 15 durometer greater than the first hardness.

Clause 5: The sole structure of any of Clauses 1-4, wherein the second cushioning body underlies a portion of the first cushioning body in the forefoot region and establishes a ground-facing exterior surface of the unitary sole in the forefoot region under the portion of the first cushioning body.

Clause 6: The sole structure of Clause 5, wherein the first cushioning body has a continuous configuration that extends along a foot-facing exterior surface of the unitary sole from a first portion of the periphery in the forefoot region, through the midfoot region and into the heel region, and extends along the ground-facing exterior surface of the unitary sole from the first portion of the periphery in the forefoot region, through the midfoot region and into the heel region.

Clause 7: The sole structure of Clause 5, wherein the first cushioning body has a lateral extremity between a longitudinal midline of the unitary sole and a lateral side exterior surface of the unitary sole at the foot-facing exterior surface in the forefoot region, and the second cushioning body extends from the lateral side exterior surface of the unitary sole to the lateral extremity of the first cushioning body at the foot-facing exterior surface in the forefoot region.

Clause 8: The sole structure of Clause 7, wherein the second cushioning body has a medial extremity between the longitudinal midline and the medial side exterior surface of the unitary sole at the ground-facing exterior surface in the forefoot region, and the first cushioning body extends from the medial side exterior surface of the unitary sole to the medial extremity of the second cushioning body at the ground-facing exterior surface in the forefoot region, the lateral extremity of the first cushioning body at the foot-facing exterior surface being nearer the lateral side exterior surface of the unitary sole than is the medial extremity of the second cushioning body at the ground-facing exterior surface.

Clause 9: The sole structure of Clause 8, wherein the first cushioning body overlies the second cushioning body between the medial extremity of the second cushioning body and the lateral extremity of the first cushioning body in the forefoot region.

Clause 10: The sole structure of any of Clauses 7-9, wherein the second cushioning body has a wedge surface that interfaces with the first cushioning body at the lateral extremity of the first cushioning body.

Clause 11: The sole structure of Clause 10, wherein the wedge surface angles upward and laterally outward toward the lateral side exterior surface of the unitary sole from a lower interior surface of the first cushioning body overlaying the second cushioning body to the foot-facing exterior surface.

Clause 12: The sole structure of any of Clauses 10-11, wherein an angle between the wedge surface and a vertical axis is from about 5 degrees to about 45 degrees.

Clause 13: The sole structure of any of Clauses 10-12, wherein the wedge surface extends along the lateral extremity of the first cushioning body in one or more of the forefoot region, the midfoot region, and the heel region.

Clause 14: The sole structure of any of Clauses 1-13, wherein the first cushioning body extends from a foot-facing exterior surface of the unitary sole to a ground-facing exterior surface of the unitary sole in the midfoot region and in the heel region, and is bordered by the second cushioning body extending from the foot-facing exterior surface to the ground-facing exterior surface at a periphery of the first cushioning body in the midfoot region and in the heel region.

Clause 15: The sole structure of any of Clauses 1-14, wherein the first cushioning body includes a first upwardly-extending flange at a first portion of the periphery of the unitary sole, and the second cushioning body includes a second upwardly-extending flange at a second portion of the periphery of the unitary sole, the first upwardly-extending flange and the second upwardly-extending flange partially defining a footbed recess at a foot-facing exterior surface of the unitary sole.

Clause 16: The sole structure of any of Clauses 1-15, wherein the first cushioning body comprises a first foam material and the second cushioning body comprises a second foam material.

Clause 17: The sole structure of any of Clauses 1-16 in combination with a footwear upper defining a foot-receiving cavity and an ankle opening; wherein the unitary sole is configured to be removably insertable into the foot-receiving cavity through the ankle opening.

Clause 18: The sole structure of any of Clauses 1-17, wherein the first cushioning body and the second cushioning body are flush with one another at a foot-facing exterior surface of the unitary sole.

Clause 19: An article of footwear comprising: an outsole; an upper secured to the outsole and defining a foot-receiving cavity and an ankle opening; a unitary, full-length midsole having a forefoot region, a midfoot region, and a heel region, and configured to be removably inserted into the foot-receiving cavity through the ankle opening; wherein the midsole comprises a first cushioning body having a first hardness and a second cushioning body having a second hardness greater than the first hardness; wherein the second cushioning body underlies the first cushioning body in a portion of a forefoot region of the midsole such that the first cushioning body establishes a foot-facing exterior surface of the midsole and the second cushioning body establishes a ground-facing exterior surface of the midsole where the first cushioning body overlies the second cushioning body; and wherein the first cushioning body establishes both the foot-facing exterior surface of the midsole and the ground-facing exterior surface of the midsole in a central portion of the heel region of the midsole.

Clause 20: The article of footwear of Clause 19, wherein the first cushioning body is exposed at a periphery of the midsole at a medial side exterior surface of the midsole in the forefoot region; and wherein the second cushioning body is exposed at the periphery of the midsole at a lateral side exterior surface of the midsole in the forefoot region.

Clause 21: The article of footwear of any of Clauses 19-20, wherein the second cushioning body has a wedge surface that interfaces with a lateral extremity of the first cushioning body; and wherein the wedge surface angles upward and laterally outward toward a lateral side exterior surface of the midsole from a lower extent of the wedge surface to an upper extent of the wedge surface.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. As used in the description and the accompanying claims, a value is considered to be "approximately" equal to a stated value if it is neither more than 5 percent greater than nor more than 5 percent less than the stated value. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. A sole structure for an article of footwear that has a foot-receiving cavity, the sole structure comprising:

a unitary sole configured for insertion into the foot-receiving cavity and having a forefoot region, a midfoot region, and a heel region;

wherein the unitary sole comprises a first cushioning body and a second cushioning body, the first cushioning body having a first hardness and the second cushioning body having a second hardness greater than the first hardness;

wherein both the first cushioning body and the second cushioning body are exposed at a periphery of the unitary sole;

wherein the unitary sole has a lateral side, a medial side opposite the lateral side, a forwardmost extent, and a rearmost extent opposite the forwardmost extent;

wherein the forwardmost extent is disposed in the forefoot region, and the rearmost extent is disposed in the heel region;

wherein the first cushioning body has a lateral extremity between a longitudinal midline of the unitary sole and a lateral side exterior surface of the unitary sole at a foot-facing exterior surface of the unitary sole in the forefoot region, and the second cushioning body extends from the lateral side exterior surface of the unitary sole to the lateral extremity of the first cushioning body at the foot-facing exterior surface in the forefoot region; and wherein a portion of the lateral extremity of the second cushioning body is closer to the forwardmost extent than to the midfoot region.

2. The sole structure of claim 1, wherein the second cushioning body extends to the forwardmost extent of the unitary sole, only the first cushioning body is exposed along a first portion of the periphery, and the second cushioning body is exposed along a remainder of the periphery.

3. The sole structure of claim 2, wherein the first portion of the periphery is at a medial side exterior surface of the unitary sole in the forefoot region.

4. The sole structure of claim 1, wherein the second hardness is from about 5 durometer to about 15 durometer greater than the first hardness.

5. The sole structure of claim 1, wherein the second cushioning body underlies a portion of the first cushioning body in the forefoot region and establishes a ground-facing exterior surface of the unitary sole in the forefoot region under the portion of the first cushioning body.

6. The sole structure of claim 5, wherein the first cushioning body has a continuous configuration that extends along a foot-facing exterior surface of the unitary sole from a first portion of the periphery in the forefoot region, through the midfoot region and into the heel region, and extends along the ground-facing exterior surface of the unitary sole from the first portion of the periphery in the forefoot region, through the midfoot region and into the heel region.

7. The sole structure of claim 1, wherein the second cushioning body has a medial extremity between the longitudinal midline and a medial side exterior surface of the unitary sole at a ground-facing exterior surface in the forefoot region, and the first cushioning body extends from the medial side exterior surface of the unitary sole to the medial extremity of the second cushioning body at the ground-facing exterior surface in the forefoot region, the lateral extremity of the first cushioning body at the foot-facing exterior surface being nearer the lateral side exterior surface of the unitary sole than is the medial extremity of the second cushioning body at the ground-facing exterior surface.

8. The sole structure of claim 7, wherein the first cushioning body overlies the second cushioning body between the medial extremity of the second cushioning body and the lateral extremity of the first cushioning body in the forefoot region.

9. The sole structure of claim 1, wherein the second cushioning body has a wedge surface that interfaces with the first cushioning body at the lateral extremity of the first cushioning body.

10. The sole structure of claim 9, wherein the wedge surface angles upward and laterally outward toward the lateral side exterior surface of the unitary sole from a lower interior surface of the first cushioning body overlaying the second cushioning body to the foot-facing exterior surface.

11. The sole structure of claim 9, wherein an angle between the wedge surface and a vertical axis is from about 5 degrees to about 45 degrees.

12. The sole structure of claim 9, wherein the wedge surface extends along the lateral extremity of the first cushioning body in one or more of the forefoot region, the midfoot region, and the heel region.

13. The sole structure of claim 1, wherein the first cushioning body extends from a foot-facing exterior surface of the unitary sole to a ground-facing exterior surface of the unitary sole in the midfoot region and in the heel region, and is bordered by the second cushioning body extending from the foot-facing exterior surface to the ground-facing exterior surface at a periphery of the first cushioning body in the midfoot region and in the heel region.

14. The sole structure of claim 1, wherein the first cushioning body includes a first upwardly-extending flange at a first portion of the periphery of the unitary sole, and the second cushioning body includes a second upwardly-extending flange at a second portion of the periphery of the unitary sole, the first upwardly-extending flange and the second upwardly-extending flange partially defining a footbed recess at a foot-facing exterior surface of the unitary sole.

15. The sole structure of claim 1, wherein the first cushioning body comprises a first foam material and the second cushioning body comprises a second foam material.

16. The sole structure of claim 1, wherein the first cushioning body and the second cushioning body are flush with one another at a foot-facing exterior surface of the unitary sole.

* * * * *